US007297059B2

(12) United States Patent
Vancura et al.

(10) Patent No.: US 7,297,059 B2
(45) Date of Patent: Nov. 20, 2007

(54) PROGRESSIVE GAMING SYSTEM AND METHOD HAVING FRACTIONAL PROGRESSIVE JACKPOT AWARDS

(75) Inventors: Olaf Vancura, Las Vegas, NV (US); Scott R. Lewis, Henderson, NV (US)

(73) Assignee: Progressive Gaming International Corporation, Las Vegas, NV (US)

( * ) Notice: Subject to any disclaimer, the term of this patent is extended or adjusted under 35 U.S.C. 154(b) by 648 days.

(21) Appl. No.: 10/347,532

(22) Filed: Jan. 17, 2003

(65) Prior Publication Data

US 2003/0181231 A1 Sep. 25, 2003

Related U.S. Application Data

(60) Provisional application No. 60/411,074, filed on Sep. 16, 2002, provisional application No. 60/350,501, filed on Jan. 24, 2002.

(51) Int. Cl.
*A63B 13/00* (2006.01)

(52) U.S. Cl. ..... 463/27; 463/25; 463/28; 463/29

(58) Field of Classification Search ..... 463/26–27
See application file for complete search history.

(56) References Cited

U.S. PATENT DOCUMENTS 4,837,728 A * 6/1989 Barrie et al. ..... 463/27
4,861,041 A 8/1989 Jones et al.
4,948,134 A 8/1990 Suttle et al.
4,964,638 A 10/1990 Ishida
5,116,055 A 5/1992 Tracy
5,249,800 A 10/1993 Hilgendorf et al.
5,275,400 A * 1/1994 Weingardt et al. ..... 463/12
5,344,144 A 9/1994 Canon
5,472,194 A 12/1995 Breeding et al.
5,564,700 A * 10/1996 Celona ..... 463/27
5,584,485 A 12/1996 Jones et al.
5,611,730 A 3/1997 Weiss
5,645,486 A 7/1997 Nagao et al.

(Continued)

FOREIGN PATENT DOCUMENTS

EP 0 521 599 7/1993

(Continued)

OTHER PUBLICATIONS

G3 Electronic Auxiliary System for Live Casino Table Games, pp. 1-12, DEQ Systems Corp., Canada.

(Continued)

*Primary Examiner*—John M Hotaling, II
(74) *Attorney, Agent, or Firm*—Dorr, Carson & Birney, P.C.

(57) ABSTRACT

A method for paying a progressive jackpot in a wide area progressive system having a progressive controller linked to groups of gaming terminals. Each gaming terminal using software determines, based upon at least the broadcast current progressive jackpot amount and the received wager, at least one fractional portion of the broadcast current progressive jackpot amount that may be won by the player when a progressive event occurs in play of the casino game of chance at the gaming terminal. The fractional progressive jackpot amount is delivered from the gaming terminal back to the progressive controller where it is deducted before the next current progressive jackpot amount is broadcast.

19 Claims, 6 Drawing Sheets

| WAGER PER LINE | | PROGRESSIVE | | PROGRESSIVE AWARD |
|---|---|---|---|---|
| (U) | | Jackpot Fractional Payoff Eligibility Portion (P) | | Dollars |
| WA | L=1 | PA | 10% | $ 100,000 |
| WB | 2 | PB | 20% | $ 200,000 |
| WC | 3 | PC | 30% | $ 300,000 |
| WD | 4 | PD | 50% | $ 500,000 |
| WE | M=5 | PE | 100% | $ 1,000,000 |

U.S. PATENT DOCUMENTS

| | | | | |
|---|---|---|---|---|
| 5,743,800 | A | 4/1998 | Huard et al. | |
| 5,855,515 | A | 1/1999 | Pease et al. | |
| 5,885,158 | A * | 3/1999 | Torango et al. | 463/27 |
| 6,012,982 | A | 1/2000 | Piechowiak et al. | |
| 6,077,162 | A | 6/2000 | Weiss | |
| 6,089,980 | A | 7/2000 | Gauselmann | |
| 6,102,799 | A | 8/2000 | Stupak | |
| 6,110,043 | A | 8/2000 | Olsen | |
| 6,139,430 | A | 10/2000 | Huard et al. | |
| 6,146,270 | A | 11/2000 | Huard et al. | |
| 6,146,271 | A | 11/2000 | Kadlic | |
| 6,146,273 | A | 11/2000 | Olsen | |
| 6,168,523 | B1 | 1/2001 | Piechowiak et al. | |
| 6,213,877 | B1 * | 4/2001 | Walker et al. | 463/26 |
| 6,217,448 | B1 | 4/2001 | Olsen | |
| 6,224,484 | B1 | 5/2001 | Okuda et al. | |
| 6,231,445 | B1 | 5/2001 | Acres | |
| 6,283,473 | B1 | 9/2001 | Abramopoulos et al. | |
| 6,336,859 | B2 | 1/2002 | Jones et al. | |
| 6,358,149 | B1 | 3/2002 | Schneider et al. | |
| 6,364,768 | B1 | 4/2002 | Acres et al. | |
| 6,431,983 | B2 | 8/2002 | Acres | |
| 6,454,648 | B1 | 9/2002 | Kelly et al. | |
| RE37,885 | E | 10/2002 | Acres et al. | |
| 6,475,088 | B1 | 11/2002 | Jones et al. | |
| 6,568,682 | B1 | 5/2003 | Hogan et al. | |
| 6,726,564 | B2 | 4/2004 | Hogan et al. | |
| 6,964,416 | B2 * | 11/2005 | McClintic et al. | 273/273 |
| 7,029,395 | B1 * | 4/2006 | Baerlocher | 463/20 |
| 7,070,505 | B2 | 7/2006 | Vancura et al. | |
| 2002/0115484 | A1 | 8/2002 | Byrne | |

FOREIGN PATENT DOCUMENTS

| | | |
|---|---|---|
| GB | 2148037 A | 5/1985 |
| WO | WO 97/29818 | 8/1997 |
| WO | WO 99/03544 | 1/1999 |
| WO | WO 00/30720 | 6/2000 |
| WO | WO 01/10523 | 2/2001 |
| WO | WO 01/32280 | 5/2001 |
| WO | WO 02/40118 | 5/2002 |

OTHER PUBLICATIONS

DEQ Systems Corp. and Mikohn Gaming Forge Alliance on Electronic Auxiliary Table Game Systems Technology—Press Release, Feb. 25, 2004, 2 pages, DEQ Systems Corp., Canada.

* cited by examiner

| WAGER PER LINE | | | PROGRESSIVE | | RATIOS |
|---|---|---|---|---|---|
| | U | $\frac{U}{M}$ | Jackpot Fractional Payoff Eligibility Portion (P) | | $R = \frac{P}{W}$ |
| WA | L=1 | 0.2 | PA | 10% | 0.1 |
| WB | 2 | 0.4 | PB | 20% | 0.1 |
| WC | 3 | 0.6 | PC | 30% | 0.1 |
| WD | 4 | 0.8 | PD | 50% | 0.125 |
| WE | M=5 | 1.0 | PE | 100% | 0.2 |

*Fig. 4*

| WAGER PER LINE | | PROGRESSIVE | | PROGRESSIVE AWARD |
|---|---|---|---|---|
| (U) | | Jackpot Fractional Payoff Eligibility Portion (P) | | Dollars |
| WA | L=1 | PA | 10% | $ 100,000 |
| WB | 2 | PB | 20% | $ 200,000 |
| WC | 3 | PC | 30% | $ 300,000 |
| WD | 4 | PD | 50% | $ 500,000 |
| WE | M=5 | PE | 100% | $ 1,000,000 |

*Fig. 5*

PROGRESSIVE GAMING SYSTEM AND METHOD HAVING FRACTIONAL PROGRESSIVE JACKPOT AWARDS

RELATED APPLICATIONS

This non-provisional application claims the benefit of U.S. Provisional Patent Application entitled "Wide Area Progressive Having Fractional Awards" having Ser. No. 60/411,074 filed Sep. 16, 2002 and U.S. Provisional Patent Application entitled "Method of Awarding Progressive Jackpots" having Ser. No. 60/350,501 filed on Jan. 24, 2002.

BACKGROUND OF THE INVENTION

1. Field of the Invention

The present invention relates to progressive gaming systems and methods and, more particularly, to progressive systems and methods having fractional awards.

2. Discussion of the Background

Progressive gaming systems and methods are utilized by the gaming industry to increase revenues from play of casino games of chance and to offer excitement and incentive to players of such casino games of chance. It is recognized that gaming terminals linked in a progressive gaming system create more frequent jackpots, a greater rate of incrementing the progressive amount, and a greater visibility than possible with stand-alone casino games of chance. As a result, players react with increased coin-in. A typical so-called wide area progressive gaming system links multiple casinos and affords players in each casino a chance to win a large jackpot. The conventional term "coin-in" generically refers to the wager or bet made by a player in what ever form such as, but not limited to coin, bills, tickets, cards, credits, etc.

A wide area progressive gaming system provides a central progressive controller in communication with casino games of chance (gaming terminals) located in dispersed physical sites such as, for example, in groups of gaming terminals (such as in "island" of gaming terminals under a large overhead display showing the progressive award values), at different casinos, and/or in different cities. A number of different topological configurations, communication networks, communication protocols, and gaming terminals are commercially available.

All such conventional linked progressive systems and methods fund and award progressive jackpot(s) based under control of the progressive controller. Typically, the coin-in values from each gaming terminal, as played by players, are continuously monitored and the progressive controller contributes a percentage to the jackpot pool. For example, if a maximum bet of $3 (i.e., 3 dollars "coin-in") at a gaming terminal qualifies the player for a chance to win the progressive jackpot, then the progressive controller receives this information and contributes a percentage such as 3% or 9 cents to the jackpot pool. The funding for the progressive jackpot pool typically includes a percentage of all coins-in. Hence, if a player bets $2 (i.e., not qualifying for the progressive), a 3% or 6 cent contribution to the progressive jackpot is still made. This function (called "funding") continuously occurs with coin-in data obtained from all gaming terminals being played. Some systems provide levels of separate progressive awards from separate jackpot pools with each pool separately funded. All such separate pools are separately funded by a specified percentage of all coins-in. Progressive systems are designed to support a predetermined number of levels such as, for example eight, but the casino and/or manufacturer operating the systems can configure it for a suitable number within the predetermined number, can select the percentage contribution for each level, etc.

The progressive controller receives the coin-in data from the gaming terminals and funds each separate progressive jackpot pool. When a progressive jackpot payoff event for a configured level occurs in a gaming terminal (i.e., a player playing the casino game of chance in the gaming terminal wins the progressive), the gaming terminal communicates the occurrence of the progressive event to the progressive controller. The controller informs the linked gaming terminals of the progressive win in typically a celebration mode, and then the progressive jackpot for that level is awarded. As this exhausts the jackpot pool for that level, it is restarted from a reset (or funded from a "seed" plus a reserve pool or the like) and the new jackpot value for the level is broadcast out to all progressive displays for the gaming terminals. The new progressive jackpot value for that level is simultaneously displayed at all gaming terminals. A progressive jackpot award in one level does not affect the jackpot values in the other levels as they are separate pools separately funded.

The progressive controller is responsible for all contributions, calculations, and sending out all new display information to the progressive displays. The gaming terminals do not have any of this control responsibility. Some gaming terminals display the broadcast progressive jackpot value. One advantage of performing all functions at the progressive controller is that it provides a secure, centralized controller and database. The progressive system monitors the coin-in meter at each gaming terminal and receives the occurrence of the progressive event as reported from the gaming terminal. The gaming terminal itself is generally "dumb" or "ignorant" of the progressive jackpot value being awarded as the game controller in the gaming terminal primarily operates the casino game of chance for the player. That is, although the progressive jackpot value is sent to the physical location of the gaming terminal (e.g., to a display within the slot machine), the slot machine controller that controls and operates the slot machine does not accept as input for game play or modify the broadcast progressive jackpot value. The gaming terminal, in some conventional systems, may receive the broadcast progressive jackpot value to display it and/or re-send the value back to the progressive controller when won.

In such conventional progressive systems, players playing the casino game of chance in the gaming terminals are sometimes disappointed. For example, if the gaming terminal has only one progressive jackpot payoff level for players placing a maximum wager (i.e., max coin-in), then any player placing less than maximum wager misses out on receiving the progressive jackpot when the qualifying event occurs in the casino game of chance. E.g., if the qualifying event is aligning four 7s on the payline, and if the player is eligible with a maximum bet of 3 coins, then a player aligning four 7s on the payline but wagering only 1 coin will instead receive a fixed prize (e.g., 1,000 coins) or alternatively be paid from a smaller progressive prize pool dedicated only to this wager of 1 coin-in. Hence, a need exists to eliminate such player disappointment and to further increase player participation and excitement by paying such players a fraction of the progressive jackpot. A further need exists to enable the gaming terminal to receive the progressive jackpot value when it is displayed simultaneously to all progressive displays and to determine such fractional payoffs independent of the progressive controller. A further need exists to communicate the award of such fractional value payoffs to the progressive controller so that the progressive controller can deduct such fractional awards from the progressive jackpot. As the progressive jackpot payoffs are based on separate jackpot pools in the progressive controller, a need exists to provide such fractional payoffs for the jackpot pool in each level. A further need exists to enhance game play at the game level, by taking as input the progressive jackpot value, and based upon specific rules of play, allowing the player to win a function of the progressive jackpot value as calculated by the game terminal. A further need exists to provide fractional progressive awards for a jackpot level.

SUMMARY OF THE INVENTION

The present invention solves the aforesaid needs by providing a method for paying a progressive jackpot in a system having a progressive controller linked to groups of gaming terminals. In one aspect, the method of the present invention broadcasts a current progressive jackpot amount from the progressive controller into each of the linked gaming terminals in each of the groups. The player at one of the gaming terminals places a wager which is received by the gaming terminal to enable the player to play a casino game of chance resident therein. The gaming terminal using software incorporating the method of the present invention determines a fractional value based upon at least (1) the broadcast current progressive jackpot amount and (2) the received wager when a progressive event occurs in play of the casino game of chance. When the progressive event occurs during play of the casino game of chance, the determined progressive jackpot value is delivered from the gaming terminal back to the progressive controller. These determined fractional progressive jackpot amounts are less than the broadcast progressive jackpot amount and is based on a function of the received wager (or other function in the play of the casino game of chance). In the wager function embodiment, the player controls the fractional amount received by the value of the received wager which can range from a lowest value to a maximum value.

In a second embodiment of the method of the present invention, fractional awards less than a broadcast progressive jackpot amount are made to the player of a slot machine linked in a progressive gaming system. The progressive system broadcasts the progressive jackpot value to be won by the player when a progressive event occurs in the play of the slot machine by the player. The player places a wager of U units on at least one payline of the slot machine having a maximum wager of M units. The placed wager is received by the slot machine. The player is then paid a fractional amount less than the broadcast progressive jackpot amount based on the wager of U units, where U is less than M and when the progressive event(s) occurs in the play of the slot machine. Other embodiments and variations of the methods of the present invention are discussed herein.

BRIEF DESCRIPTION OF THE DRAWINGS

FIG. 4 sets forth a fractional progressive payoff eligibility table.

FIG. 5 sets forth an example of a fractional progressive award payoff.

DETAILED DESCRIPTION OF THE INVENTION

1. Overview

Figure 1:
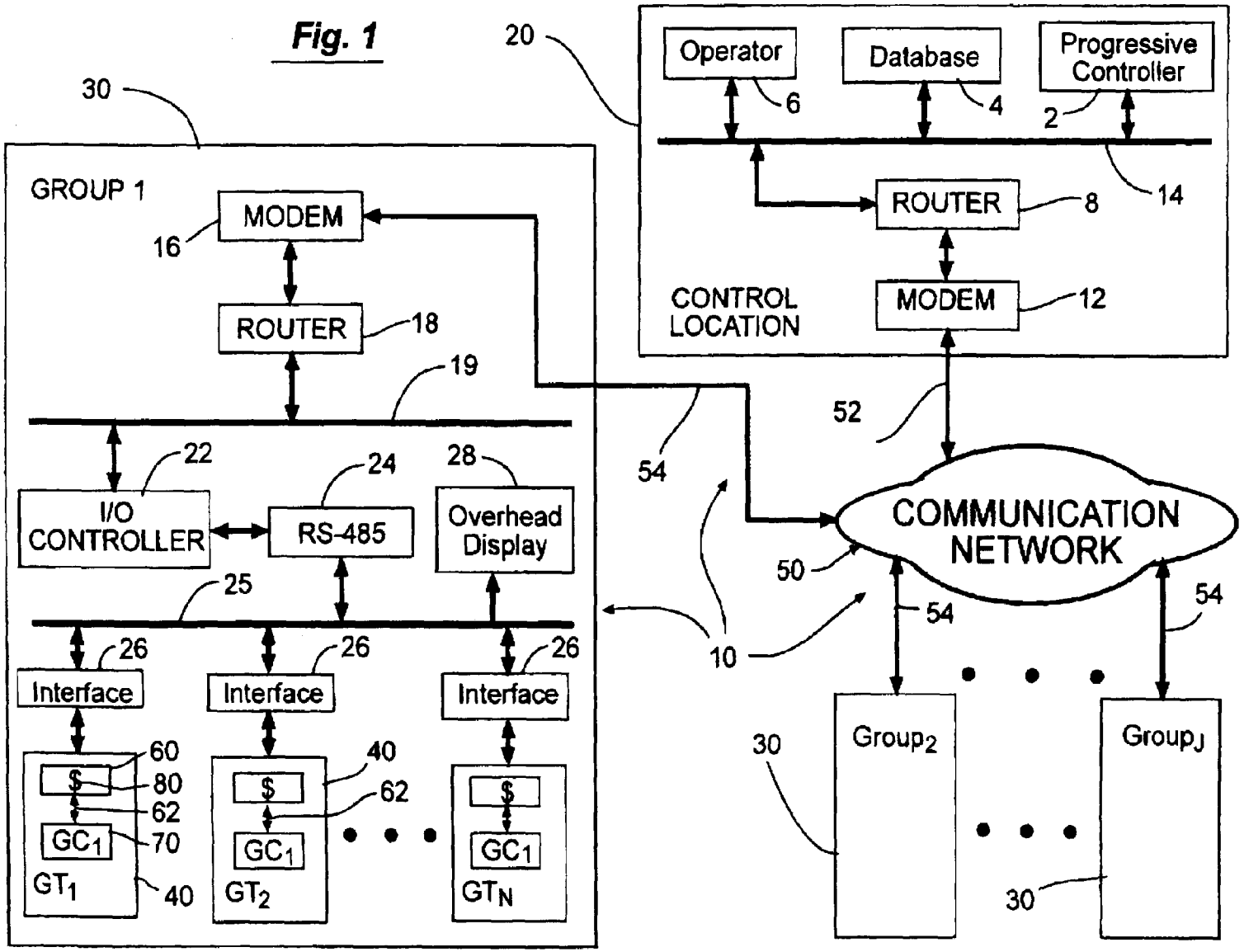
FIG. 1 is a block diagram showing the modifications to the progressive system environment which incorporate the methods of the present invention.

In FIG. 1, a wide area progressive jackpot system 10 incorporating the methods of the present invention is shown. A progressive controller 2 is shown at a control location 20 communicating with groups 30 of gaming terminals (GT) 40 over a communication network 50.

The term "gaming terminal" is used in its broadest sense to be synonymous with, but not limited to, gaming system, gaming device, gaming machine, etc. A gaming terminal can be, but not limited to, stand-alone, incorporated into another gaming terminal, etc. A gaming terminal can also be connected to, but not limited to, a network, the Internet, a progressive system, a telecommunications network, etc. It is to be appreciated that conventional gaming terminal 1200 designs are vigorous and encompass a wide variety of conventional designs to incorporate any number of conventional casino games of chance.

The progressive controller 2 can be any of a number of conventional progressive controllers modified according to the teachings of the present invention contained therein. One such conventional progressive controller 2 is available from Mikohn Gaming Corporation known as CASINOLINK Linked Progressive Jackpot System.

In FIG. 1, the control location 20 contains the progressive controller 2, a database server 4, and an operator/administrator workstation 6 in communication with an Ethernet 14. The Ethernet 14 also connects to a router 8 which in turn is connected to a modem 12. The functional block diagram for control location 20 is conventional except as modified with respect to the methods of the present invention. The functional block diagram is that for the aforesaid CASINOLINK system and it is to be expressly understood that a number of other functional system approaches could likewise be modified under the teachings of the present invention.

The communication network 50 can be any conventional communication network utilizing any of a number of other conventional networks. This could include any hardwired, wireless, and/or telecommunication network including the Internet communicating with each group 30 of gaming terminals 40. The communication network 50 could include conventional switches, modems, routers, telephone connections, T1 or DSL lines, external firewalls, etc. In one embodiment, the progressive controller 2 can be located in a given casino and hardwired through cabling 50 to each group 30 and each group 30 could be an island of gaming terminals 40 located at various locations in the casino. In another embodiment, the groups 30 can be located in different casinos, in different locations, etc. How the progressive controller 2 communicates with each group 30 is performed in many different conventional designs. The communication network 50 in FIG. 1 is conventional.

Each group 30 may comprise any number of gaming terminals 40 and the gaming terminals 40 may incorporate any suitable casino game of chance (with or without bonus games) such as a slot game, a video slot game, video poker, video keno, etc. The location of each group 30, the number of gaming terminals 40, and the nature of each individual casino game of chance in the gaming terminal 40 is a matter of design choice under the teachings of the present invention.

Each group 30, in one embodiment, has a modem 16 connected to a router 18 which is connected to an Ethernet 19. On the Ethernet 19 is the Input/Output controller 22 which is connected through a conventional RS-485 communication port 2 to the serial bus 25 which, in one embodiment, is a half-duplex serial bus 25. An overhead display 28 is connected to the bus 25 as are interface cards 26. These components provide two-way data communication between each interface card 26 and the communication network 50. The functional components discussed above are found in the aforesaid CASINOLINK system and it is to be expressly understood that a number of other functional system approaches could likewise be modified under the teachings of the present invention as discussed later.

As shown in FIG. 1, each gaming terminal 40 has an internal progressive display 60 and a gaming control (GC) 70. In conventional progressive systems, the progressive controller 2 broadcasts through the communication network 50 into the displays 28 and 60 the current progressive jackpot value 80 that can be won in the progressive game. Each gaming terminal 40 in each group displays the same dollar value 80 based upon this simultaneous broadcast. The displays 28 and 60 in conventional systems displays conventional units of value in any denomination, currency, award designation, etc. In a conventional fashion, as each gaming terminal 40 is played, a portion of the wager (or bet) made by players is credited from the gaming terminal 40 back through the communication network 50 to the progressive controller 20. This is usually accomplished by the interface 26 reading a coin-in meter at the gaming terminal 40. Based upon the incoming contributions from each gaming terminal 40 that is played, the progressive controller 2 uploads through the communication network 50 to the displays 28 & 60 the new progressive values 80. The functional components discussed above are found in the aforesaid CASINOLINK system and it is to be expressly understood that a number of other functional system approaches could likewise be modified under the teachings of the present invention as discussed later.

Under the teachings of the present invention, each gaming terminal 40 in each group 30, in addition to the conventional displaying 60 of the value 80, has access 62 to the value 80. Based on this access 62, the game control 70 delivers to players of the gaming terminal 40 awards based upon the value 80. In one embodiment, these are fractional progressive awards. As will be explained in the ensuing, when a fractional award is made by the game control 70 of the gaming terminal 40, the award is delivered from the gaming terminal 40 responsible for the fractional progressive award over the communication network 50 into the progressive controller 2 which then modifies the current value of the progressive jackpot by subtracting the fractional progressive award made so that a new value 80 is broadcast into displays 28 and 60 to reflect an updated value. Of course, as this occurs, contributions may also be made to increase the progressive value 80.

A group 30 includes any desired number of gaming terminals $GT_N$. A group 30 herein may include one gaming terminal, in which case, the modem may communicate directly with the gaming terminal.

Figure 2:
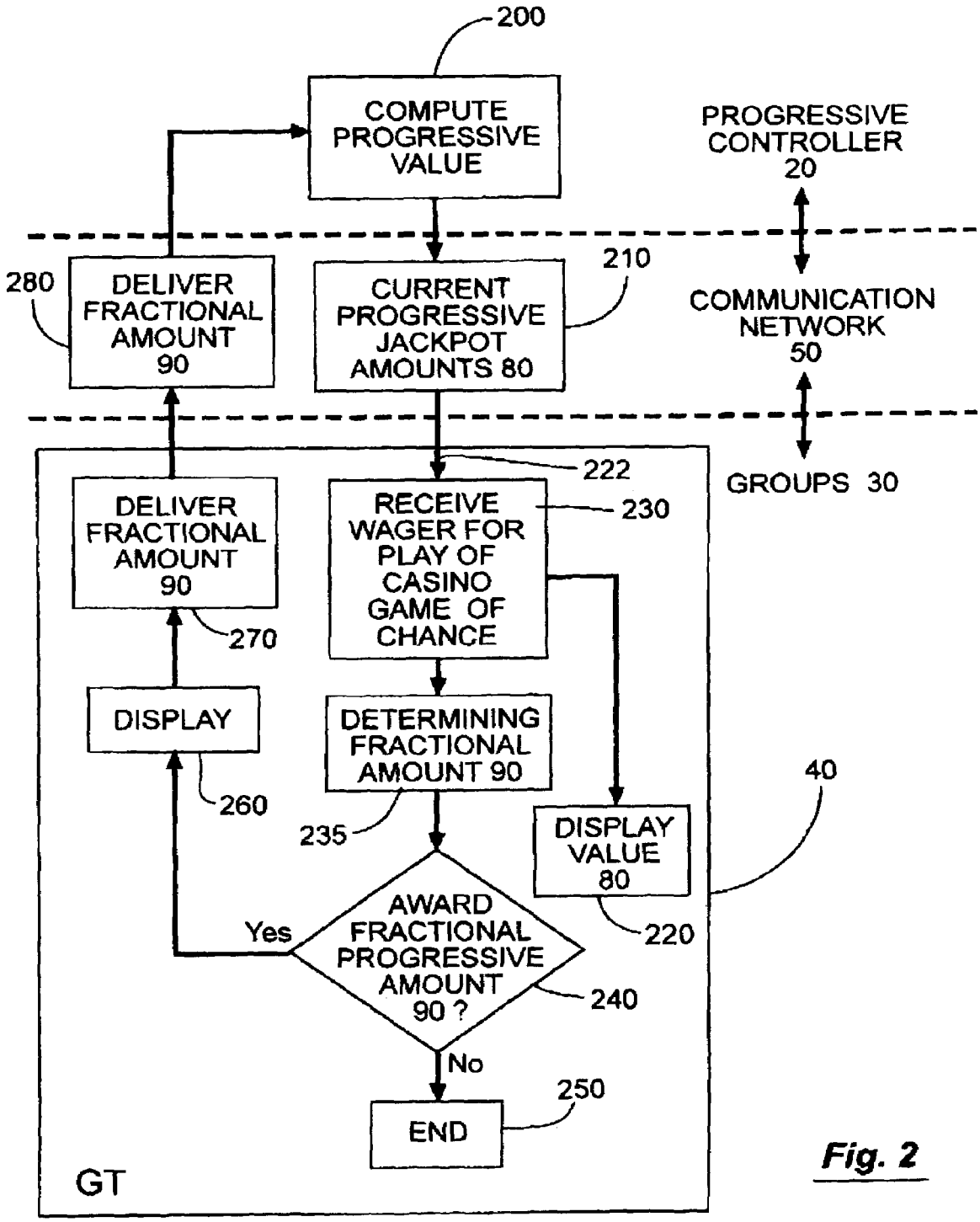
FIG. 2 sets forth one embodiment of the methods of the present invention in conjunction with the system of FIG. 1.

In FIG. 2, an overview of the method of the present invention is set forth. The progressive controller 2 in stage 200 continually computes and broadcasts a progressive value 80. The progressive value 80 is delivered 210 through the communication network 50 to each of the groups 30. The broadcast conventionally occurs continuously based upon coin-in contributions from all of the gaming terminals GT being played by players. Conventionally the broadcast value is displayed having a rolling odometer effect. Even though no gaming terminals are played at a group, the display continuously shows the current progressive jackpot amount 80.

In each gaming terminal 40 of each group the value 80 is displayed 220 in either or both the overhead display 28 and display 60. Whether or not there are other displays of this value 80 in, at, or near the gaming terminal 40 is not material to the present invention. Game control 70, under the teachings of the present invention, receives the value 80 for use in play 230 of the casino game of chance GC and for display 220 before, during, and/or after the play of the casino game of chance. A wager is received 230 from a player at the casino game of chance resident in the gaming terminal 40 being played. The fractional amount 90 based on the received wager and the broadcast current progressive jackpot amount 80 is determined 235 by software in the gaming terminal 40. Such determination 235 can occur when the wager is received, at any time during the play of the casino game of chance, or when the progressive event occurs. When a progressive event occurs in the play 230 of the casino game of chance, the game control 70 determines 240 whether to award the full or a fractional portion of the progressive. If the progressive event does not occur, the play normally ends 250. The term "progressive event" is whatever "event" is configured or designed into the casino game of chance. There exist a wide variety of "progressive events" available for casino games of chance linked together in a progressive system. Furthermore, in some progressive systems, different groups of gaming terminals may have different progressive events. Many "progressive events" are conventional and include, but are not limited to the random appearance of a predetermined game outcome such as three 7s or a hearts royal flush. The present invention works with any desired progressive event including conventional progressive events or progressive events designed for casino games not yet in existence. The determination of the fractional progressive award can occur in response to receiving the wager, during play of the casino game of chance and/or when the progressive event occurs.

If the progressive event occurs during play 230, then in stage 240 the award is made. The winning event is displayed 260 with the amount 90 to be awarded. The displaying 260 can occur to the player and/or to all gaming terminals in the group 30 and/or to all groups 30. The amount 90 is then outputted 270 from the gaming terminal 40 through 280 the communication network 50 to the progressive controller 2. Progressive controller 2 computes 200 a new progressive value by deducting the delivered award 90 as will be explained in greater detail later. The process of FIG. 2 then repeats. What is not shown are the conventional steps involved with respect to the contribution based on the wager (coin-in) from each gaming terminal 40 played that is conventionally delivered to the progressive controller 20 through the communication network 50. FIG. 2 shows the various method steps incorporating the method of the present invention for the fractional awards of the present invention. It is to be expressly understood that some method steps can occur in different orders. For example, steps 260 and 270 can occur in parallel, in sequence or another fashion. A wide variety of communication protocols can be used between the progressive controller 2, the communication network 50 and each gaming terminal 40 for each group 30.

The present invention pertains to the gaming terminal 40 using the broadcast value 80 from the progressive controller 20 in the play 230 of the casino game of chance as by awarding 240 fractional progressive amounts 90 based on conventional progressive events occurring in the play 230. Next, the present invention provides a return communication method from the gaming terminal 40 to the progressive controller 20 as represented by steps 260, 270, and 280 to the progressive controller 2 wherein the fractional progressive award value 90 is delivered. In all conventional progressive controller systems play 230 of the casino game of chance never involves the determination and awarding of a fractional amount 90 of the broadcast progressive value 80 as determined automatically by the game control 70 in the gaming terminal.

In summary of FIG. 2, the method of the present invention for paying a fractional progressive jackpot amount 90 in a system 10 having a progressive controller 2 linked to a plurality of gaming terminals 40 (such as in, but not limited to groups 30) includes: broadcasting 210 a current progressive jackpot amount 80, receiving 230 a wager for play of a casino game of chance from a player at one of the gaming terminals, determining 235 at the gaming terminal being played, based on the broadcast current progressive jackpot amount and the received wager at least one fractional progressive jackpot amount 90, and then awarding 240 that amount 90 to the player. The awarded amount 90 is also delivered 270, 280 to the progressive controller 200.

2. Gaming Terminal 40

Figure 3:
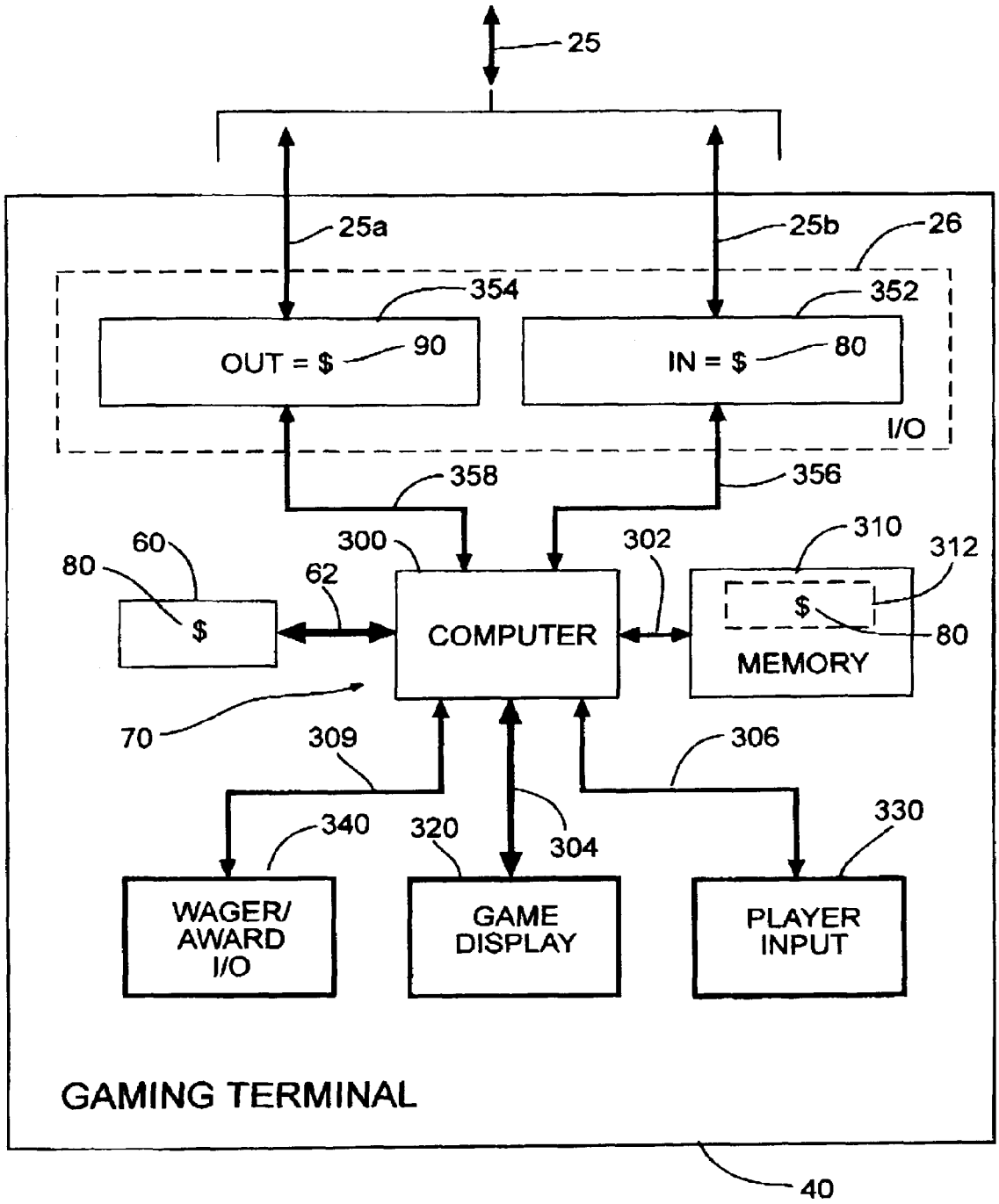
FIG. 3 sets forth the functional components of a gaming terminal of the present invention.

In FIG. 3, the functional block diagrams for the various components in the gaming terminal 40 are shown. It is to be appreciated that conventional gaming terminal 40 designs are vigorous and encompass a wide variety of conventional designs to incorporate any number of conventional casino games of chance. Functionally such gaming terminals 40 contain a game control 70 that includes a computer 300, a memory 310, a game display 320, a player input 330, a wager/award input/output 340 and in the case of a progressive environment, an I/O (or interface card) 350.

The gaming terminal 40 of the present invention utilizes computer 300 which could be any suitable controller, microprocessor, etc. accessing either internal or external memory 310 over a suitable communication path 302. The present invention is not limited to the type of computer 300, type of memory 310 or type of communication path 302.

The game display 320 comprises many different types of game displays including, but not limited to mechanical, electronic, video, or combinations thereof. The game display 320 displays to a player the base game casino game of chance and/or any bonus games. The game display 320 may include a single display or a plurality of displays. The nature and design of the display for the casino game of chance is immaterial as many different commercially available devices can be used.

Player input 330 may also comprise one or many different conventional input devices 330 which would include separate buttons, switches, etc. The player input 330 may also be incorporated into the game display 320 when the game display is also a touch screen. Indeed, the player input 330 may be separate and/or part of the game display 320. The nature and design of the player input 330 for the casino game of chance is vigorous as many different commercially available devices can be used.

The wager/award input/output 340 is also conventionally known and includes a wide variety of coin in, currency reader, ticket reader, credit in, coin out, ticket out, credit display, credit out, award of payoffs and prizes during the play of the game, etc. The nature and design of the wager/award input/output 340 for the casino game of chance is vigorous as many different commercially available devices can be used for individually or collectively for the input/output 340.

The input/output 26 is a communication module (interface card) that enables communication with the I/O controller 22 on bus 25 (and thence through the communication network 50 with the progressive controller 20) in any one of numerous conventional fashions. The nature and design of the input/output 26 for the gaming terminal 40 is vigorous as many different commercially available devices can be used.

It is expressly understood that the functional block diagram gaming terminal 40 is represented in different functional descriptions with different components based upon gaming terminal design requirements and the like. Hence the functional blocks shown and their interconnection are meant to be illustrative and not limiting to the teachings of the present invention. Under the teachings of the present invention, the broadcast progressive value 80 delivered from the progressive controller 2 through the communication network 50 is delivered into the I/O 26 and stored in register 352 (or hardware of software buffer) for subsequent delivery to the computer 300 for the embodiment shown in FIG. 3. The computer 300 accesses register 352 and downloads the progressive value 80, in a suitable digital form or protocol, and displays the value 80 in display 60 (and/or game display 320) and also stores the value 80 in a suitable memory location 312 of memory 310. As will be explained later, the computer 300 through suitable software programming has access to the value 80 in the memory location 312 based upon progressive events occurring in the play of the casino game of chance. As the casino game of chance is displayed in game display 320 and played by a player, the computer 300 under software control can award, upon the occurrence of the progressive events, fractional portions of the value 80 from the memory location 312.

When a fractional portion of the value 80 award occurs in the play 230 of the casino game of chance, the computer under software control displays this award 90 in displays 60 and 320 (and may further display celebration of this winning event in celebration displays, multimedia, etc.) (not shown). When this occurs, the computer 300 under software control outputs the fractional amount 90 to the output register 354 (or hardware or software buffer) in I/O 26 for delivery to I/O controller 22 (and thence through 280 the communication network 50 to the progressive controller 20). It is to be understood that I/O registers 352 and 254 are shown separate, but need not be so as any I/O interface could be utilized.

The calculations of the fractional amount 90 in the embodiment set forth in FIGS. 2 and 3 can be modified to be performed in the interface 26 or the I/O controller 22 each of which typically includes a computer capable of numerical calculations. Or, performed in the progressive controller 2. In such modified embodiments, the game terminals 40 report the progressive event (as is conventionally done) along with data necessary to determine the fractional amount 90 (such as coin-in information). In other modified embodiments, the numerical calculations can be shared. For example, the gaming terminal 40 could calculate a numerical percentage based on coin-in which would be delivered to another computer (e.g., interface 26, I/O controller 22 and/or progressive controller 2) for determining the fractional amount 90. The methods discussed herein are conventionally programmed into the system 10 discussed above.

3. Fractional Progressive Awards

The following methods of the present invention accomplish the goal of allowing players to be eligible for a fractional portion 90 of the progressive jackpot 80 with, for example, less than maximum wagers (or other game function). In one embodiment, the progressive jackpot pay out is prorated according to the amount of the wager placed (coin-in) 340 by the player.

Figure 7:
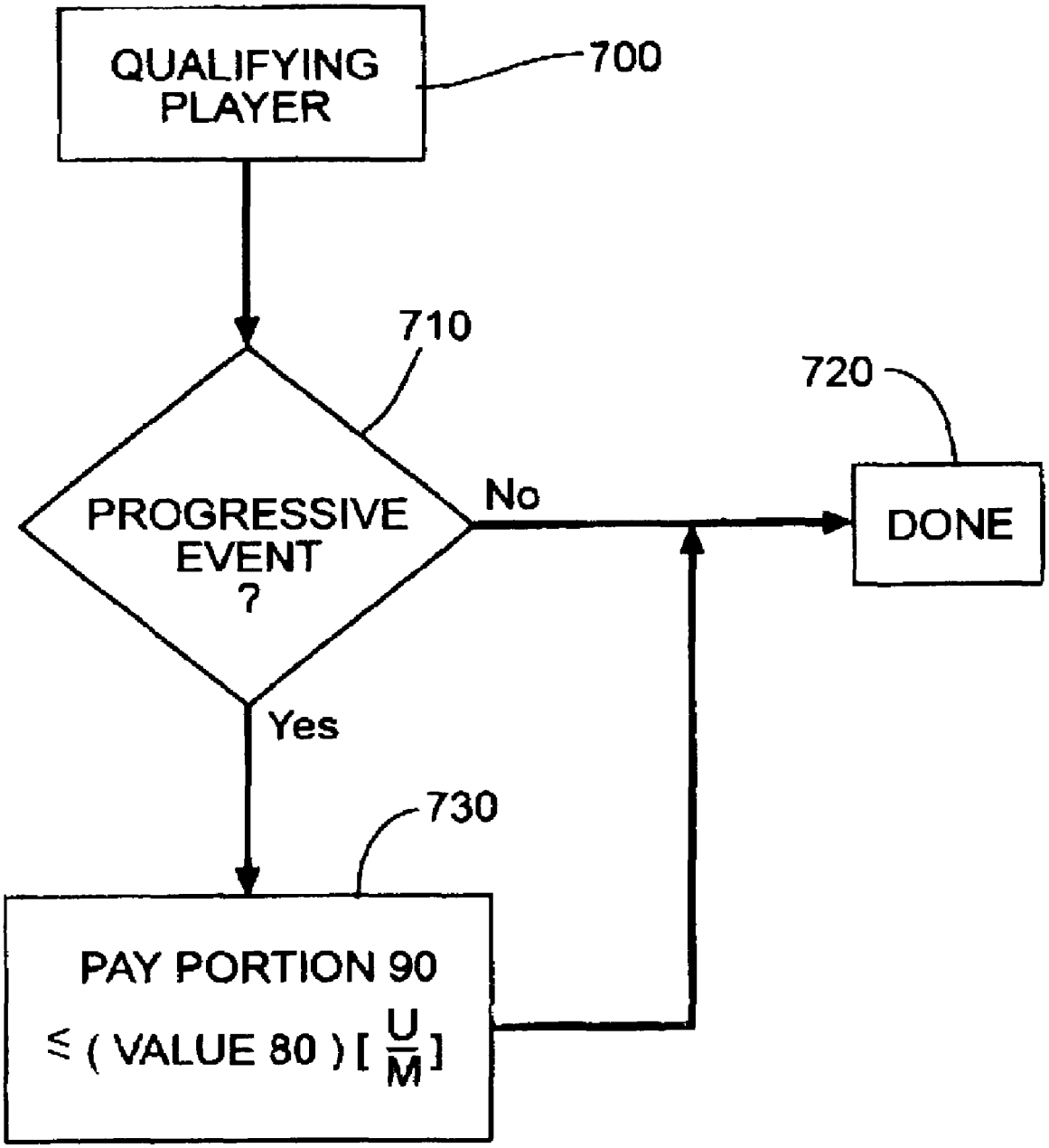
FIG. 7 sets forth the functional method steps of the embodiment of the present invention wherein the player is paid an award not more than the product of the progressive jackpot and the ratio of the amount wagered and the maximum wager.

Under a first embodiment as shown in FIG. 7, the method awards a portion of progressive jackpot to a player who has qualified 700 such as with a wager of U units on a payline during play of a casino game of chance (such as a slot machine) in gaming terminal 40. If in stage 710, no progressive event occurs, the method is done 720. If the progressive event occurs, then stage 730 is entered. If the maximum possible wager is M units on a payline for the casino game of chance, then the player is paid an amount (portion of the progressive jackpot) less than or equal to the product of the progressive jackpot payoff value 80 and the ratio of U to M. The minimum possible wager for the casino game of chance is L.

By way of example for the first embodiment and as shown in FIG. 4, assume five possible wagers in wager/award I/O 340 in the gaming terminal 40 for the casino game of chance: WA, WB, WC, WD, WE. The ratio of U/M is shown in FIG. 4. The fractional progressive awards 90 are represented as a portion of the total progressive jackpot: PA, PB, PC, PD, PE, respectively. As shown in FIG. 4, in this example, the portions (P) selected are less than U/M and can be any predetermined values, selected for the system, that are no more than U/M. In one embodiment the proportion of the progressive jackpot won is based on the amount of the wager where WA<WB<WC<WD<WE. The preferred proportion of payoffs has ratios, R, of: P/W=PA/WA<=PB/WB<=PC/WC<=PD/WD<=PE/WE. When the portion award equals U/M, then the ratio, R, is constant and, in the case of this example P=U/M and R=0.2. FIG. 4 sets forth the fractional progressive payoffs in place for this example. By assigning, in this example, wagers W (coins), wherein WA=1, WB=2, WC=3, WD=4, & WE=5, and ratios, R, wherein R=0.1<=0.1<=0.1<=0.125<=0.2, are obtained. In this manner, therefore, any player who wagers on the casino game of chance in the gaming terminal 40 is eligible for a fractional portion of the progressive jackpot, but those who wager more (in particular, those who wager 4 coins) receive a better "fractional value" in that the ratio of portion to wager is higher. The conventional progressive award is maintained when M=5 and the entire payoff occurs. The example of FIG. 4 is based on a 5 coin maximum bet for a payline. The method of the present invention is adaptable to any bet configuration for a casino game of chance including, but not limited to, 2 coin, 3 coin, 4 coin, etc. casino games of chance. In a preferred embodiment, when the player places the wager or bet, but before the casino game of chance commences play, the progressive amount for which the player is potentially eligible for is displayed.

Several alternate embodiments exist for the first-stage (of one or more stages) of a base-game jackpot qualification means. In describing these alternatives, the following example of 5 trigger symbols on a jackpot-eligible payline as the winning combination is used. However, the method of the present invention is equally applicable with any other combination of symbols on a payline. The approach is applicable under many conditions, but by way of further example assume the casino game of chance is a 9-line, 45-coin game. Hence the maximum bet M per payline is 5 coins and the lowest bet L per payline is 1 coin. These embodiments are summarized in the following table for a multi-bet, multi-payline casino game of chance such as this example of a 5 coin, 9 payline game:

| Type of Wager Required | Eligible on | Eligible for |
|---|---|---|
| Any Bet on Any Payline | Individual Payline | Fractional or Top Award |
| Any Bet on All Paylines | All Paylines | Fractional or Top Award |
| Any Bet on All Paylines | Prescribed Payline | Fractional or Top Award |

The first embodiment, as already described, allows the player to be eligible for a fractional portion 90 of the progressive jackpot amount 80 by wagering any amount U on any payline from L to M. To provide an incentive for the casino game of chance player to bet M, the payoff percentage P similar to that shown in FIG. 4 is used. For the example of betting up to 5 coins on each of 9 paylines, the ratio values R in FIG. 4 are used for each payline. The term "eligible" is the amount of the progressive value capable of being won by a player. The term "qualifying" occurs when the player achieves a required outcome (to win) the progressive amount. Qualification may be more than one step under the teachings of the present invention. For example, a players places a one-coin wager and is eligible to win 10% of the progressive amount 80. If during play of the underlying game of chance at the gaming terminal, the player) aligns five jackpot symbols, the player qualifies in a first step. In a second step of this example, the player is presented with a trivia question, and if the player correctly answers, the player qualifies and wins the fractional progressive amount 90 of 10% of the progressive amount 80. The aforesaid example is only an example and any number of steps in qualifying could be used and what constitutes qualification is not limited to aligning symbols or answering trivia questions.

In a second embodiment, the player is eligible for at least a fractional portion 90 of the jackpot 80 provided the player has placed any bet on all paylines (rows 2 and 3 in the above table). In the example of 5 coins and 9 paylines, the player would have to wager U on all 9 paylines, but again, the player need not bet the maximum M (U=5) on all 9 paylines and need only bet L (U=1) on each of the 9 paylines. In this second embodiment, the progressive event for winning the progressive jackpot may be, e.g., the alignment of 5 common symbols on any one of the 9 paylines (row 2 in the above table) or it may be the alignment of 5 common symbols on a prescribed payline (e.g., the $9^{th}$ payline)(row 3 in the above table). In this second embodiment, what is advantageous is that the player wagering on all 9 paylines is eligible to win a portion of the progressive jackpot even if not wagering the theoretical maximum M on each play. This is shown in FIG. 5 for the row 2 and row 3 designs in the above table. If a player, bets U=2 coins on each of nine paylines and the progressive event of 5 common symbols appears on any payline (row 2 design in the above table) or on a prescribed payline (row 3 design in the above table), then the player receives 20% of the progressive jackpot value 80 as a fractional progressive award value 90. If the progressive award 80 is $1,000,000, then the fractional amount 90 is $200,000.

As mentioned, the numerical calculations could, in modified embodiments of the present invention, be performed, either in whole or in part, in other processors found in the interface 26, the I/O controller 22 and/or the progressive controller 2 (or elsewhere). For example and with reference to FIG. 4, the gaming terminal 40 could communicate the progressive event occurrence plus the percentage P to the I/O controller 22 which would then calculate the fractional value 90 as it would also have the progressive value 80. Or, the percentage P could be delivered to the progressive controller which could perform the calculation. Many variations exist under the teachings of the present invention.

In one variation of the present invention, the progressive jackpot is won in two stages, the first stage comprises the aligning of traditional symbols on the base game (i.e., a predefined winning combination in the casino game of chance) and the second stage is a trivia (or strategy) game. First, the player must meet predefined criteria on the base game. This first step of qualification of a player is accomplished, e.g., by aligning 5 trigger symbols left to right on any active payline in a slot casino game of chance. The word "qualifying" is used in its broadest sense herein and is not limited to aligning 5 trigger symbols as it could be any predefined event in the game such as, for example, a random symbol appearance, a random coin-in occurrence, a predefined symbol outcome in combination with a prescribed wager and number of lines played, etc. Thereafter, as a second step of qualification, a trivia question is posed on-screen to the player. If the player is right in answering the trivia question, then the player has successfully completed both stages of qualification and therefore wins the progressive jackpot. If wrong on the trivia stage, then the player wins a consolation prize of 25% of the jackpot. In some embodiments, a two-stage process need not be used and in which case the traditional one-step means of qualifying on the base game is used as discussed above. Alternately, a multi-stage process could be used.

In FIG. 5, an example of a progressive award 90 payoff for the progressive percentage portions of FIG. 4 is set forth for a progressive award 80 of $1,000,000 which is broadcast to all gaming terminals 40. Assume, in this example, that a player places a wager of two coins per line in the above nine line casino game of chance example. In the event a progressive event is hit in the play of the game (e.g., three red 7s), the player, under the teachings of the present invention, would receive $200,000. In operation, with reference back to FIG. 2, the game terminal 40 detects the presence of the progressive event and the two wagers per line which have been made by the player so in step 240 alerts the player to the fractional progressive award of $200,000 In such awards, it is conventional for the casino (or the owner of the gaming terminal) to verify the win and to pay the player usually by check. A display 260 is made to the player either in the onscreen display 320 or other suitable display 60 in the gaming terminal 40. The fractional amount 90 (in this example, $200,000) is delivered 270 through the communication network 50 in step 280 to the progressive controller 2. The progressive controller 2 is immediately made aware that gaming terminal 40 has a possible progressive award 90 to be made to the player. The progressive controller 2 (depending on the conventional progressive controller) usually enters a pending mode until verification of the win is made. It is to be expressly understood that in delivering the fractional amount 90 other suitable information such as the identification of the gaming terminal 40, the time of the award, etc. can be delivered to the progressive controller 2. Progressive controller 2 in step 200 deducts the award 90 from its current progressive award determination. At the time of this deduction, the progressive award 80 of $1,000,000 which was broadcast at a time prior to the win by the player at the gaming terminal 40 has increased through contributions. For example, assume the actual progressive jackpot at the time of the deduction is $1,000,099. The progressive controller 2 deducts $200,000 (i.e., 20%) from this amount and rebroadcasts the new progressive value 80 of $800,099.

In summary of the above embodiments based on receiving a wager, the method of the present invention includes: receiving a wager of U units from a player on at least one payline of the casino game of chance (e.g., a slot machine) wherein the maximum wager is M and paying the player an amount less than the progressive jackpot amount based on the wager of U units where U is less than M when the progressive event occurs.

It is expressly understood that the progressive controller 2 is preferably continually updating and increasing the value 80 based upon contributions from all of the gaming terminals being played. It is also to be understood that other gaming terminals 40 may award fractional portions 90 which may come in at the same time which would then have to be deducted. The progressive controller 2 has control over these deductions. The player at the winning gaming terminal 40 who won the $200,000, in this example, is paid that amount through conventional celebration and whatever the sponsoring casino desires to do.

Figure 6:
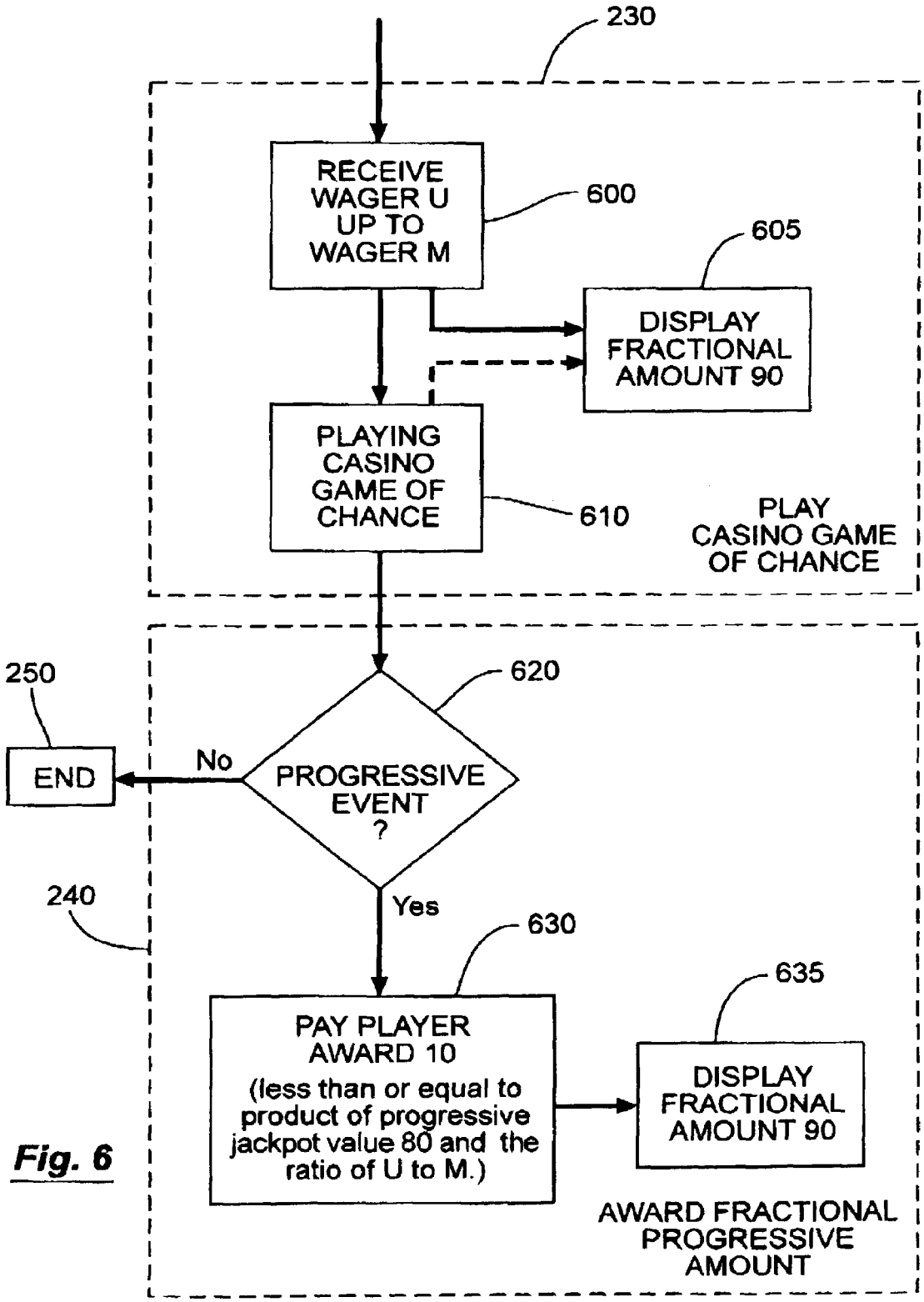
FIG. 6 sets forth the functional method steps of one embodiment of the present invention.

In FIG. 6, one embodiment of the present invention for paying a player is set forth. The player places the wager 600 wherein the wager U, as set forth above, is a value between L and M. When the wager is received by the gaming terminal 40, the computer 300 in the gaming terminal 40 can now actually display 605 in the game display 304 or other suitable display 60 not only the broadcast progressive value 80 but also the fractional value 90 that the player is actually entitled to based upon the wager amount. For example and with reference to FIG. 5, if the player placed a wager of U=3 (e.g., $3.00) then based upon the amount of the actual wager the computer 300, in software incorporating the method of the present invention, determines the fractional amount 90 of $300,000 based on the broadcast value 80 of $1,000,000, that the player is qualified to win in the progressive as determined by the gaming terminal 40. This fractional amount is displayed 605 so that the player is fully informed of that award for that possible win. It is to be understood that both amounts 80 and 90 can be displayed and perhaps in a fashion encouraging the player to wager U=M for the next game. Or, only the fractional amount 90 could be displayed.

The player then plays a casino game of chance 610 and a determination is made in the gaming terminal 40 whether a progressive event occurs in step 620. Whatever the progressive event is, and when it occurs, the gaming terminal 40 pays the player an amount less than or equal to the product of the progressive jackpot and the ratio of U to M in stage 630. Likewise, when the progressive event occurs, a display 635 of the fractional amount being won is made. This can be accompanied by conventional celebration multimedia, etc. This display can occur in a game display 320 or other suitable displays 60 at the gaming terminal 40. As explained above, this then is reported back to the progressive controller.

It is to be expressly understood that this mathematical relationship represents one embodiment of the present invention. Any suitable mathematical relationship or, predetermined configuration by the casino operator of the present invention, could be utilized. For example, the casino operator would have the ability to select fractional progressive awards 90 based upon its own mathematical formulas and/or an arbitrary basis. For example, a casino in FIG. 5 may choose to have the following fixed fractional values 90 for a progressive event involving three red 7s: $77,777 (for U=1); $177,777 (for U=2); $277,777 (for U=3); and $577,777 (for U=4) whenever the broadcast progressive values go over $1,000,000. Of course, the maximum bet of U=M results in the standard progressive payoff 80 which would be greater than $1,000,000 in this example. The determination of the fractional payoff portion 90 for a player can mathematically be based such as by the algorithm expressed above or arbitrarily selected.

With respect to FIGS. 2 and 6, it can be appreciated that steps 620 and 630 of FIG. 6 are contained within step 240 and that steps 600 and 610 are found in step 230. What is taught, under another embodiment of the present invention, is a method for paying a progressive jackpot in a progressive system with a central controller 2 linked to a number of gaming terminals 40. In this method embodiment, the current progressive jackpot value 80 is broadcast 210 from the progressive controller 2 to each of the gaming terminals 40 as previously discussed. At each gaming terminal 40, wagers are received 600. The casino game of chance is played. When a progressive event is detected 620, the player is paid 630 an award 90. This award could be up to the maximum value broadcast or in this example $1,000,000 in the example in FIG. 5. Determination of the progressive event 620 and the paying of the player 630 occurs at the gaming terminal 40 based upon the rules of play for that particular casino game of chance. Once the determination is made the award and is displayed 260 in FIG. 2 and the amount 90 is delivered 270 and 280 to the progressive controller 2 which recomputes 200 the new progressive value 80. Under this embodiment, the method of the present invention for paying a progressive jackpot includes: broadcasting 210 the current progressive jackpot amount 80 from the progressive controller 2 to each of the gaming terminals 40. It also includes receiving wagers 600 for the play of a casino game 610 in the gaming terminal 40. It also includes determining at each gaming terminal wagered on based upon the rules of play (i.e., what is a "progressive event") whether it has occurred and if it has, what the current broadcast progressive amount 80 is, the wager was received 600, and what the at least one jackpot value 80 is won by the player. If the at least one progressive jackpot value has been won, under the teachings of the present invention, that amount 90 is delivered 270, 280 back to the progressive controller 2 to compute a new progressive value 200.

The fractional award 90 can be determined based on function other than coin-in. Any suitable base game or bonus game function can be utilized. In one embodiment, U=M and the fractional amounts 90 are obtained when progressive events occur in a bonus round(s) of a bonus game to the base casino game of chance.

For example, if in a game with two-step qualifying procedure, the first step may be to align five YAHTZEE cups on a payline. If the chart in FIG. 4 is used and if the player wagered three coins, then in the first step the player has a potential fractional progressive win of 30%. Or if the progressive amount is $1,000,000 a fractional amount 90 of $300,000. The second step may be to require the player to play a YAHTZEE game. If the result of such play is a YAHTZEE of sixes (i.e., 5 sixes), then 100% of the potential progressive amount in step 1 may be awarded or $300,000. Any other YAHTZEE outcome (e.g., 5 threes) pays 30% of the potential progressive amount in step 1 or $90,000. The above example shows how vigorous the method of the present invention is. First, a plurality of steps can be utilized to qualify the player for the fractional progressive award. Each step can be based on a random casino game of chance outcome and/or based on player control of the outcome in a skill, strategy and/or knowledge casino game. Second, each step can provide a fractional portion of the prior step. In the above example, the first step provides a potential fractional progressive award of 30% (based on a three coin wager) and a second step of either 100% or 30% of the prior potential fractional award in step 1 (based on a game outcome).

It is to be understood that many variations are possible and that fractional awards could be greater than 100%. In another example of a broadcast progressive amount 80 of $1,000,000, a third step is added. The first step of this example the fractional potential award is based on wager and the occurrence of the progressive event (e.g., 5 symbols, 4 coin-in per FIG. 4, 50% potential progressive award (or $500,000)). The second step is based on a successful random casino game outcome (e.g., YAHTZEE of 5 sixes) potentially pays 120% (or $600,000) of the potential award in Step 1, any other YAHTZEE (i.e., 5 threes) potentially pays 100% of the potential award (or $500,000) in Step 1, finally any other outcome for the five dice rolled results in 30% (or $90,000). In a variation, the player may be given an option to stop after any given step. In this example, if the player opts to proceed (or automatically proceeds) the third step may be a trivia question. If answered correctly the player receives 150% of the potential award in prior step (either $900,000, $750,000 or $135,000) if answered correctly or if answered incorrectly the player receives 75% (either $450,000, $375,000 or $67,500). All of this adds to player excitement in moving through the steps. Variations of the present invention based on this example would not go over the broadcast progressive amount 80.

As another example, a player wagering U=M may qualify in a single-step process on the base game as follows. With 5 banana slug symbols left to right on the $15^{th}$ payline, the player wins 100% of the progressive amount. With 4 banana slug symbols left to right on the $9^{th}$ payline, the player wins 5% of the progressive amount 80. Alternatively, with 5 banana slug symbols left to right on any payline other than the $15^{th}$, the player wins 25% of the progressive amount.

Indeed, the awarding of less than the top award may be a function of game outcome (as described in the preceding paragraphs), the initiating wager, or both.

The above disclosure sets forth a number of embodiments of the present invention. Those skilled in this art will however appreciate that other arrangements or embodiments, not precisely set forth, could be practiced under the teachings of the present invention.

We claim:

1. A method for paying a current progressive jackpot in a system having a progressive controller linked to a plurality of gaming terminals, the current progressive jackpot awarded when a maximum wager for play of a casino game of chance in one of the plurality of gaming terminals is made and when a progressive event occurs in the play of the casino game of chance, the method comprising:

funding, at the progressive controller, the current progressive jackpot amount for the maximum wager with a portion of any wager received at the plurality of gaming terminals;

broadcasting the current progressive jackpot amount from the progressive controller into the system;

receiving in each of the plurality of gaming terminals in the system, the broadcast current progressive jackpot amount from the progressive controller;

receiving a wager less than the maximum wager for play of the casino game of chance from a player at one of the plurality of gaming terminals, all received wagers in each of the plurality of gaming terminals being eligible for at least a portion of the progressive jackpot amount for the maximum wager;

determining, in the aforesaid one gaming terminal receiving the wager, based upon at least said received broadcast current progressive jackpot amount for the maximum wager and said received wager, at least one fractional progressive jackpot amount that is won by the player when the progressive event occurs in the casino game of chance played in response to the received wager;

when the progressive event occurs, delivering the determined at least one fractional progressive jackpot amount that has been won by the player from the aforesaid one gaming terminal to the progressive controller;

when the progressive event occurs, awarding the determined at least one fractional progressive jackpot amount to the player;

deducting the delivered at least one fractional progressive amount from the current progressive jackpot amount in the progressive controller prior to a next broadcast from the progressive controller.

2. A method of awarding less than a progressive jackpot amount to a player of a casino game of chance in a slot machine linked in a progressive gaming system, the slot machine having a plurality of paylines, the progressive system broadcasting the progressive jackpot amount to the linked slot machine, the progressive jackpot amount awarded when a maximum wager M is made on at least one payline of the plurality of paylines and when the progressive event occurs in play of the casino game of chance in the slot machine, the method, in the progressive gaming system, comprising:

receiving, in the slot machine, from the player a wager of U units on at the least one payline of the plurality of paylines of the slot machine to play the casino game of chance;

funding the progressive jackpot amount for the maximum wager M with a portion of the wager U units;

determining an amount less than the broadcast progressive jackpot amount for the maximum wager M based on the wager of U units, where U is less than M, in response to receiving the wager when the progressive event occurs in the play of the casino game of chance in the slot machine; so that all received wagers U are eligible for at least a portion of the progressive jackpot amount for the maximum wager M;

awarding the player the determined amount when the progressive event occurs in the play of the casino game of chance in the slot machine;

deducting the determined amount from the progressive jackpot amount for the maximum wager M in response to the occurrence of the progressive event.

3. The method of claim 2 wherein the amount determined is less than the product of the broadcast progressive jackpot amount and the ratio of U to M.

4. The method of claim 2 wherein the amount determined is based on predetermined portion percentages associated with each unit of U.

5. The method of claim 2 further comprising:

the determining occurring in the slot machine;

delivering the determined amount from the slot machine to a progressive controller in the progressive gaming system;

deducting in the progressive controller the determined amount from the progressive jackpot amount.

6. A method of awarding a portion of a broadcast progressive jackpot to a player who wagers U units on a payline of a multi-reel, multi-payline slot machine to play a casino game of chance, wherein a minimum possible wager of L units and a maximum possible wager of M units exists on the payline so that L less than or equal to U, which is less than or equal to M the method comprising:

funding the broadcast progressive jackpot with part of the wager of U units;

qualifying the player for the progressive jackpot with a wager of U units on the payline;

determining a portion of the broadcast progressive jackpot based on the wager of U units when L less than U which is less than M;

paying the player the broadcast progressive jackpot when U=M and in response to the occurrence of a progressive event in the play of the casino game of chance in the multi-reel, multi-payline slot machine;

paying the player the portion of the broadcast progressive jackpot when L less than or equal to U which is less than M and in response to the occurrence of the progressive event in the play of the casino game of chance in the multi-reel, multi-payline slot machine;

wherein the portion is less than or equal to the product of the broadcast progressive jackpot and the ratio of U to M, and greater than or equal to the product of the broadcast progressive jackpot and the ratio of U to L.

7. The method of claim 6 wherein qualifying requires wagers on all of the multi-paylines of the slot machine.

8. The method of claim 6 wherein qualifying is identical regardless of units wagered.

9. The method of claim 6 wherein the first portion is less than or equal to the product of the broadcast progressive jackpot and the ratio L to M.

10. The method of claim 6 wherein qualifying the player requires the same symbol to appear on each reel of a payline in the multi-reel, multi-payline slot machine.

11. The method of claim 6 wherein qualifying the player requires only reel symbols.

12. The method of claim 6 wherein qualifying the player requires at least one reel symbol appearing on the payline and the successful completion of a strategy game.

13. The method of claim 6 wherein qualifying the player requires at least one reel symbol appearing on the payline and the successful completion of a knowledge-based game.

14. The method of claim 6 wherein qualifying the slot machine player requires at least one reel symbol appearing on the payline and the successful completion of a bonus game.

15. The method of awarding a portion of a broadcast progressive jackpot in a wide area progressive system having a plurality of slot machines, each slot machine having a casino game of chance with a plurality of paylines with each payline having a maximum wager (M), a player placing an actual wager (U) to play at least one payline of the plurality of paylines, the method comprising:

funding the broadcast progressive jackpot with part of the actual wager (U);

qualifying the player of the at least one payline of the plurality of paylines of the casino game of chance in a slot machine in the plurality of slot machines for the portion of the broadcast progressive jackpot in response to placing the actual wager (U);

awarding the player the progressive jackpot in response to the occurrence of a progressive event during play of the casino game of chance in response to placing the maximum wager (M) on at least one payline;

determining, in the wide area progressive system, a portion of the progressive jackpot, when the actual wager (U) is less than the maximum wager (M), the portion determined not more than the product of the broadcast progressive jackpot and the ratio of an amount wagered (U) by the player to the maximum amount (M) that can be wagered on the at least one payline of the slot machine;

awarding the player the determined portion in response to the occurrence of a progressive event during play of the casino game of chance in response to placing the actual wager (U) on the at least one payline.

16. The method of claim 15 wherein qualifying is receiving the amount wagered in the slot machine from the player.

17. The method of claim 15 wherein the portion is predetermined based on the actual wager (U).

18. The method of claim 15 wherein the broadcast progressive jackpot is a current jackpot.

19. The method of claim 15 wherein the broadcast progressive jackpot is the actual progressive jackpot.

* * * * *